US011340020B2

(12) United States Patent
Hatfield et al.

(10) Patent No.: US 11,340,020 B2
(45) Date of Patent: May 24, 2022

(54) HEAT EXCHANGER

(71) Applicant: HIETA TECHNOLOGIES LIMITED, Bristol (GB)

(72) Inventors: Niall Edward Hatfield, Bristol (GB); Simon Lloyd Jones, Bristol (GB)

(73) Assignee: HIETA TECHNOLOGIES LIMITED, Bristol (GB)

( * ) Notice: Subject to any disclaimer, the term of this patent is extended or adjusted under 35 U.S.C. 154(b) by 0 days.

(21) Appl. No.: 16/496,092

(22) PCT Filed: Jan. 12, 2018

(86) PCT No.: PCT/GB2018/050085
§ 371 (c)(1),
(2) Date: Sep. 20, 2019

(87) PCT Pub. No.: WO2018/178619
PCT Pub. Date: Oct. 4, 2018

(65) Prior Publication Data

US 2020/0263932 A1 Aug. 20, 2020

(30) Foreign Application Priority Data

Mar. 29, 2017 (GB) ..... 1705034

(51) Int. Cl.
*F28F 7/02* (2006.01)
*F28D 9/00* (2006.01)
(Continued)

(52) U.S. Cl.
CPC ..... *F28D 9/0068* (2013.01); *F28D 21/0001* (2013.01); *F28F 7/02* (2013.01); *F28F 2009/029* (2013.01); *F28F 2009/0287* (2013.01)

(58) Field of Classification Search
CPC .. F28D 9/0068; F28D 9/0037; F28D 21/0001; F28F 7/02; F28F 2009/0287; F28F 2009/029
See application file for complete search history.

(56) References Cited

U.S. PATENT DOCUMENTS 4,352,393 A * 10/1982 Vidal-Meza ..... F28D 9/0037 165/166
4,601,332 A * 7/1986 Oda ..... F28F 7/02 165/165
(Continued)

FOREIGN PATENT DOCUMENTS

CN 1429316 7/2003
CN 105571358 5/2016
(Continued)

OTHER PUBLICATIONS

Search Report for GB Application No. 1705034.5 dated Jul. 24, 2017, 5 pages.
(Continued)

*Primary Examiner* — Devon Russell
(74) *Attorney, Agent, or Firm* — Nixon & Vanderhye P.C.

(57) ABSTRACT

A heat exchanger component comprises a core portion with alternating first and second heat exchanging channels. A first ducting portion comprises first ducting channels for transfer a first fluid between a first fluid inlet/outlet and the first heat exchanging channels of the core portion, and second ducting channels for transfer of second fluid between a second fluid inlet/outlet and the second heat exchanging channels of the core portion. The first ducting channels direct the first fluid around the turn of at least 45 degrees and the second ducting channels direct the second fluid around a turn of at least 90 degrees. The first and second ducting channels are interleaved.

16 Claims, 9 Drawing Sheets

(51) Int. Cl.
*F28D 21/00* (2006.01)
*F28F 9/02* (2006.01)

(56) References Cited

U.S. PATENT DOCUMENTS

| | | | | |
|---|---|---|---|---|
| 6,059,025 | A * | 5/2000 | Hossfeld | F28D 9/0068 165/166 |
| 7,065,873 | B2 * | 6/2006 | Kang | F28D 9/0018 165/166 |
| 7,285,153 | B2 * | 10/2007 | Bruun | F23C 13/00 95/43 |
| 9,528,774 | B2 * | 12/2016 | Xia | H05K 7/206 |
| 10,415,901 | B2 * | 9/2019 | Ranjan | F28F 7/02 |
| 2001/0025700 | A1 * | 10/2001 | Cottingham | F28D 21/0012 165/54 |
| 2009/0194268 | A1 * | 8/2009 | Kristensen | B29C 65/02 165/185 |
| 2010/0071887 | A1 * | 3/2010 | Sugiyama | F24F 12/006 165/166 |

FOREIGN PATENT DOCUMENTS

| | | | | |
|---|---|---|---|---|
| CN | 107014230 | | 8/2017 | |
| EP | 1 528 350 | | 5/2005 | |
| EP | 2 357 329 | | 8/2011 | |
| GB | 2 067 277 | | 7/1981 | |
| JP | S63-140295 | | 6/1988 | |
| JP | U-H3-23729 | | 3/1991 | |
| JP | 2006-153424 | | 6/2006 | |
| WO | 2011/006579 | | 1/2011 | |
| WO | 2014/048073 | | 4/2014 | |
| WO | 2016/147359 | | 9/2016 | |
| WO | WO-2016147359 | A1 * | 9/2016 | F28F 3/08 |

OTHER PUBLICATIONS

International Search Report and Written Opinion of the ISA for PCT/GB2018/050085 dated Mar. 22, 2018, 12 pages.
First Office Action for CN Application No. 201880020274.3 dated Nov. 4, 2020 and English translation, 20 pages.
Second Office Action for CN Application No. 201880020274.3 dated Jun. 8, 2021 and English translation, 22 pages.
Office Action for JP Application No. 2019-552990 dated Dec. 22, 2021 and English translation, 10 pages.

* cited by examiner

HEAT EXCHANGER

This application is the U.S. national phase of International Application No. PCT/GB2018/050085 filed 12 Jan. 2018 which designated the U.S. and claims priority to GB Application No. 1705034.5 filed 29 Mar. 2017, the entire contents of each of which are hereby incorporated by reference.

The present technique relates to the field of heat exchangers.

A heat exchanger may include a core portion having alternating first and second heat exchanging channels for exchange of heat between a first fluid in the first heat exchanging channels and a second fluid in the second exchanging channels. Such heat exchangers can be useful for a range of applications, for example as a recuperator for recovering heat from exhaust gas from an internal combustion engine or gas turbine. Other applications can be in power generation or ventilation systems.

At least some examples provide a heat exchanger component comprising:

a core portion comprising alternating first and second heat exchanging channels for exchange of heat between first fluid in the first heat exchanging channels and second fluid in the second heat exchanging channels, wherein the first heat exchanging channels and the second heat exchanging channels are configured to direct the first and second fluids along corresponding routes in the same direction or opposite directions; and a first ducting portion comprising first ducting channels for transfer of first fluid between a first fluid inlet/outlet and the first heat exchanging channels of the core portion and second ducting channels for transfer of second fluid between a second fluid inlet/outlet and the second heat exchanging channels of the core portion, wherein the first ducting channels provide a different flow path geometry to the second ducting channels, and the first fluid inlet/outlet is separate from, and not interleaved with, the second fluid inlet/outlet;

wherein the first ducting channels are configured to direct the first fluid around a turn of at least 45 degrees;

the second ducting channels are configured to direct the second fluid around a turn of at least 90 degrees; and the first ducting channels are interleaved with the second ducting channels.

At least some examples provide a method of manufacturing a heat exchanger component, the method comprising:

forming a core portion comprising alternating first and second heat exchanging channels for exchange of heat between first fluid in the first heat exchanging channels and second fluid in the second heat exchanging channels, wherein the first heat exchanging channels and the second heat exchanging channels are configured to direct the first and second fluids along corresponding routes in the same direction or opposite directions; and forming a first ducting portion comprising first ducting channels for transfer of first fluid between a first fluid inlet/outlet and the first heat exchanging channels of the core portion and second ducting channels for transfer of second fluid between a second fluid inlet/outlet and the second heat exchanging channels of the core portion, wherein the first ducting channels provide a different flow path geometry to the second ducting channels, and the first fluid inlet/outlet is separate from, and not interleaved with, the second fluid inlet/outlet;

wherein the first ducting channels are configured to direct the first fluid around a turn of at least 45 degrees;

the second ducting channels are configured to direct the second fluid around a turn of at least 90 degrees; and the first ducting channels are interleaved with the second ducting channels.

At least some examples provide a computer-readable data structure representing a design of a heat exchanger component comprising:

a core portion comprising alternating first and second heat exchanging channels for exchange of heat between first fluid in the first heat exchanging channels and second fluid in the second heat exchanging channels, wherein the first heat exchanging channels and the second heat exchanging channels are configured to direct the first and second fluids along corresponding routes in the same direction or opposite directions; and a first ducting portion comprising first ducting channels for transfer of first fluid between a first fluid inlet/outlet and the first heat exchanging channels of the core portion and second ducting channels for transfer of second fluid between a second fluid inlet/outlet and the second heat exchanging channels of the core portion, wherein the first ducting channels provide a different flow path geometry to the second ducting channels, and the first fluid inlet/outlet is separate from, and not interleaved with, the second fluid inlet/outlet;

wherein the first ducting channels are configured to direct the first fluid around a turn of at least 45 degrees;

the second ducting channels are configured to direct the second fluid around a turn of at least 90 degrees; and the first ducting channels are interleaved with the second ducting channels.

A storage medium may store the computer-readable data structure. A storage medium may be a non-transitory storage medium.

Further aspects, features and advantages of the present technique will be apparent from the following description of examples, which is to be read in conjunction with the accompanying drawings, in which.

Figure 1:
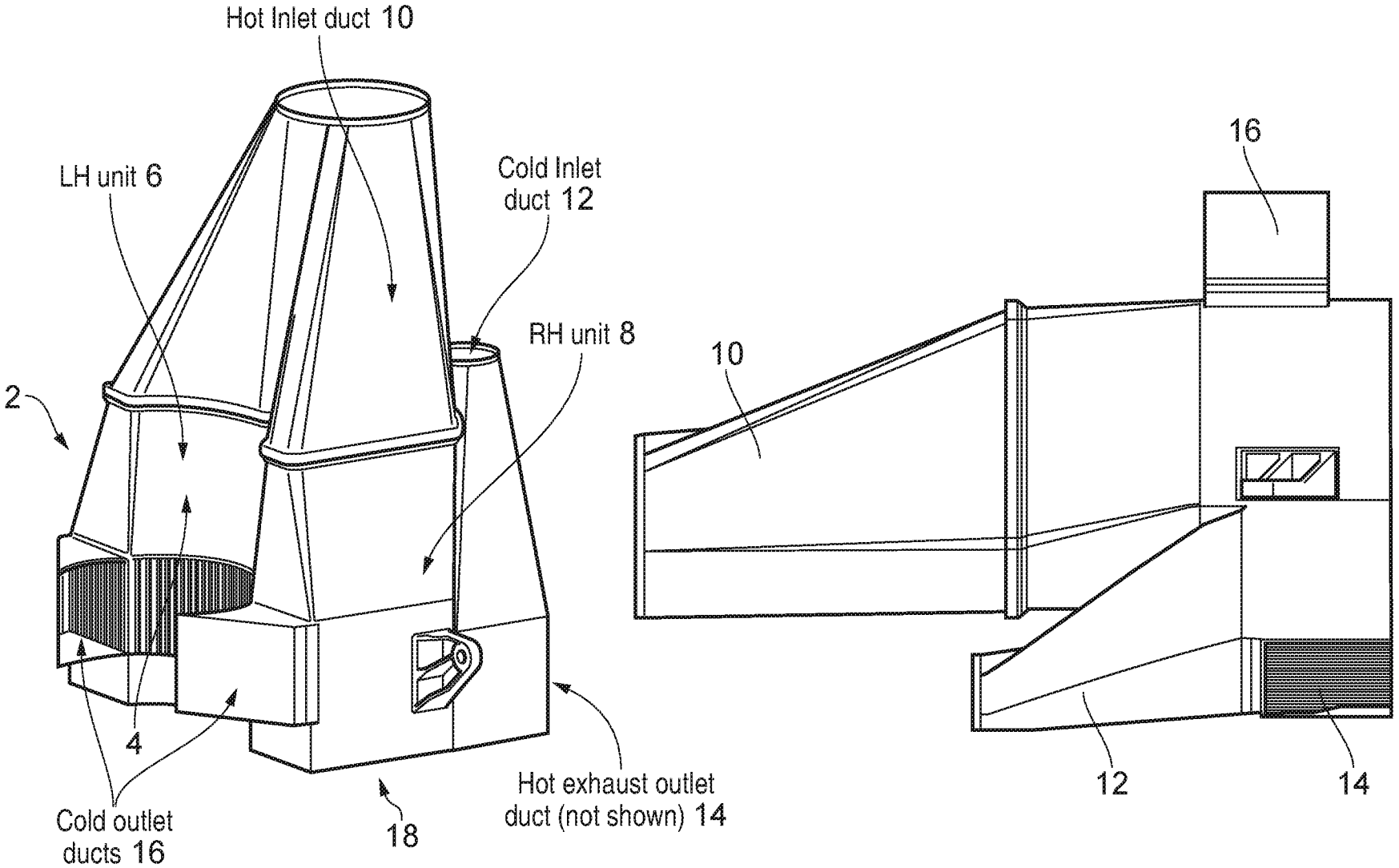
FIG. 1 shows an example of a recuperator.

In a heat exchanger component comprising a core portion with alternating first and second heat exchanging channels, providing ducting for transferring first fluid to or from the first heat exchanging channels and second fluid to or from the second heat exchanging channels can be challenging. Typically the first fluid needs to be taken from some common source and split between the first heat exchanging channels and the second fluid similarly needs to be divided from a common source between the second heat exchanging channels. Similarly, at the outlet of the heat exchanging channels, the first and second fluids may need to be directed to different locations. The simplest approach may be for one of the first and second fluids upon entering or leaving the corresponding heat exchanging channels simply to be directed straight out in the same direction of travel as within the heat exchanging channels of the core. However, in practice, design constraints associated with the particular application for which the heat exchanger is being used may constrain the locations of inlet and outlet ducts for the first/second fluids. In some cases, it may be desired for at least one of the first and second fluids to make a turn before entering or after exiting the core portion of the heat exchanger. For example, the heat exchanger may be intended to be located near a barrier such as a body panel or vehicle boot in an automotive application, or a casing of an electricity generating installation for example. Such a barrier may prevent the fluid being able to travel straight into or out of the core and so may necessitate a turn.

Hence, a ducting portion may be provided for directing the first and second fluids around turns of at least 45 degrees and at least 90 degrees respectively upon entering or exiting the heat exchanger core. Constructing channels for directing the fluid flow around the turn while maintaining sufficient heat exchange performance and pressure drop characteristics can be challenging and so typically if both fluids need to make a turn on the same side of the heat exchanger core then typically one of the fluids would be directed around the turn first with the other fluid passing straight into or out of the heat exchanger without making a turn. For example, the second fluid may be turned in a separate part of the inlet/outlet ducting which is stacked on top or below the part of the ducting which turns the first fluid. However, this can increase the volume occupied by the heat exchanger which may be undesirable for some applications where space may be extremely constrained. For example, in automotive applications, if the heat exchanger is to fit under a bonnet or below the boot of a car then space efficiency can be an important consideration.

In the heat exchanger component discussed below, a first ducting portion is provided which comprises first ducting channels for transfer of first fluid between a first fluid inlet/outlet and the first heat exchanging channels of a core portion, and second ducting channels for transfer of second fluid between a second fluid inlet/outlet and the second heat exchanging channels of the core portion. The first ducting channels are configured to direct the first fluid around a turn of at least 45 degrees, while the second ducting channels are configured to direct the second fluid around a turn of at least 90 degrees. The first ducting channels are interleaved with the second ducting channels within the first ducting portion.

Therefore, within the portion of the ducting which directs the first and second fluids around their respective turns, the channels inducing the turn in the first fluid are interleaved with the channels inducing the turn in the second fluid. While manufacturing such interleaved channels with a suitable profile for making the respective turns for the different fluids can be challenging. For example, intricately shaped channels may be designed to maintain suitable pressure drop and performance characteristics. However, the inventors recognise that manufacturing such interleaved channels is feasible, for example using additive manufacture techniques. By interleaving the first ducting channels and second ducting channels, the space efficiency of the heat exchanging can be improved since it is not necessary to stack separate ducting regions where each fluid is turned separately and sequentially.

In some cases, the heat exchanger component may comprise an entire heat exchanger. Alternatively, some heat exchangers may be manufactured in multiple parts which are then subsequently assembled, and in this case the heat exchanger component could be one of those parts. Hence, it is not necessary for the heat exchanger component to comprise the whole heat exchanger. For example, the first/second fluid inlet/outlet to/from which the fluid is directed by the first ducting portion could be a separately formed component, or the overall heat exchanger could be formed in several sections to simplify manufacturing.

The first ducting channels may provide a different flow path geometry to the second ducting channels. Within the core portion the first and second fluids may flow along corresponding routes (either in the same direction or in opposite directions). In contrast, within the first and second ducting channels the paths taken by the first and second fluids may diverge. This enables routing of the first and second fluids to or from separate first and second fluid inlet/outlets, so that the first or second fluids can be gathered from a common source or output to a common outlet with separation of the first and second fluids. Hence, the first fluid inlet/outlet may be separate from, and not interleaved with, the second fluid inlet or outlet.

In one example, the second fluid inlet/outlet may comprise an open duct which is coupled to direct second fluid into two or more of the interleaved second ducting channels of the first ducting portion or to receive second fluid from the two or more second ducting channels. For example the second fluid inlet/outlet may comprise a funnel-shaped portion with an opening at the end opposite to the end coupled to the first ducting portion, with this opening then being able to be connected to a tube or pipe receiving the second fluid from another component or for transferring the second fluid to another component. The funnel-shaped portion can spread out and direct the second fluid into the different second ducting channels of the first ducting portion, or receive second fluid from multiple second ducting channels and combine it into a common mass of fluid. In the case where the open duct corresponds to an inlet for the second fluid, it is possible to provide internal meshing within the second fluid inlet for splitting the flow of second fluid in order to promote distribution of the second fluid among the second ducting channels. In some examples the first fluid inlet/outlet could similarly comprise an open duct or funnel-like portion, but this is not essential and in some cases the first ducting channels may output the first fluid directly into the surroundings of the heat exchanger, or could gather the first fluid from the surroundings without any funneling. Other examples may have the second fluid vented directly into the surroundings and first fluid provided with a funnel-shaped inlet/outlet duct, or could have both fluids with the same type of inlet/outlet (e.g. both open inlet/vents or both with a funnel-shaped duct).

The first and second ducting channels may have barriers in portions of the channels at different locations. The first ducting channel may comprise a barrier in a portion corresponding to a location of the second fluid inlet/outlet to prevent first fluid flowing between the second fluid inlet/outlet and the first ducting channels. The second ducting channels may comprise a barrier in a portion of the second ducting channels corresponding to a location of the first fluid inlet/outlet to prevent second fluid flowing between the first fluid inlet/outlet and the second ducting channels. For example the first and second ducting channels could comprise a series of channels with planar dividing walls between adjacent first and second ducting channels. Some portions of the gaps between adjacent dividing walls can be closed off to provide barriers, while other parts of the gaps between adjacent dividing walls can be open. Hence, openings can be provided in the first/second ducting channels at different locations corresponding to the first and second fluid inlet/outlets respectively.

The second ducting channels may be configured to direct the second fluid around a turn with a greater angle than the turn provided by the first ducting channels for the first fluid. In some cases the turn provided by the second ducting channels may be greater than 90 degrees so that the second fluid is directed around a bend and back on itself between the second fluid inlet/outlet and the core portion. For example, this approach can be useful in applications where the heat exchanger is to be placed up against some barrier so that most of the ducting for transferring the first and second fluids to and from the heat exchanger core is provided on one side of the heat exchanger to avoid the barrier. In this case, at least one of the fluids may need to undergo a turn of greater than 90 degrees. Such turns can be challenging to provide in a space efficient way in conventional heat exchangers, but by interleaving turn-inducing channels for the first and second fluids within the first ducting portion, the heat exchanger can be made more space efficient.

When the first and second ducting channels are interleaved with each other, then this may provide another advantage in that this effectively increases the amount of surface area at which first and second fluids can exchange heat, enabling more efficient heat exchange. To promote more efficient heat exchange, at least one heat exchange assisting feature may be formed on an inner surface of at least one of the first ducting channels and the second ducting channels of the first ducting portion. The heat exchange assisting feature may be any surface discontinuity to increase the effective surface area at which the first or second fluid comes into proximity at the boundaries of the first and second ducting channels. For example the heat exchange assisting feature could correspond to protrusions (e.g. pins, ribs or fins) formed on an inner surface of a first and second ducting channels, or undulations in the inner surface of the channel. For example, fins could be formed on the inner surface of at least one of the first and second ducting channels, with the fins passing straight down the channels or spiraling round the inner surface of the channels, for example.

At least one of the first ducting channels and second ducting channels may also comprise a flow turning surface for directing fluid around the turn. For example, one of the first and second ducting channels could have a curved or tapered inner surface for deflecting fluid around the turn. In this case, the flow turning surface may provide an additional heat exchange surface for promoting the exchange of heat between the first and second fluids. As the fluid flows over the flow turning surface heat may be transferred through the flow turning surface to an adjacent channel comprising the other fluid.

At least one of the first ducting channels and second ducting channels can also include one or more turning vanes subdividing the channels within at least a portion of the length of the channels, to assist with directing the fluid around the turn. Hence, each first ducting channel or second ducting channel can be internally subdivided within at least part of the channel (e.g. at the portion corresponding to the corner of the turn).

In some examples, the heat exchanging channels within the core portion may have the same hydraulic diameter as the first and second ducting channels of the first ducting portion. In some cases the core portion and the first ducting portion may be formed as one integrated piece and so the core portion may simply correspond to a portion of the channels in which the first and second fluids take parallel and non-diverging paths through the core portion, while in the first ducting portion there is a divergence in the paths taken by the first and second fluids within the interleaved ducting channels.

However, in other examples the first and second ducting channels of the first ducting portion may have a greater hydraulic diameter than the first and second heat exchanging channels of the core portion. For example, in some examples each first ducting channel may correspond to multiple heat exchanging channels in the core portion with each first ducting channel leading to or from multiple subdivided regions corresponding to individual first heat exchanging channels of the core. Similarly, there could be subdivisions of the area corresponding to one second ducting channel to form multiple second heat exchanging channels of the core portion. By providing internal barriers to further partition the channels in the core portion, the heat exchange surface area can be increased providing more efficient heat exchange.

In some examples, the total frontal area of the first heat exchanging channels of the core may be greater than the total frontal area of the first fluid inlet/outlet. Similarly, the total frontal area of the second heat exchanging channels of the portion may be greater than the total frontal area of the second fluid inlet/outlet. Hence, the first ducting portion may also function to expand the frontal area between the first fluid inlet/outlet and an inlet of the core portion or reduce the frontal area between an outlet of the core portion and a first fluid outlet, and similarly the second ducting channels may expand or reduce the frontal area exposed to the second fluid.

While the core portion could in some cases be formed separately from the first ducting portion, in some examples the core portion may be integrally formed with the first ducting portion. The core portion and the first ducting portion may be formed as a consolidated mass of material. For example, additive manufacture may be used to create the core portion and the first ducting portion as one piece of consolidated material built up layer by layer.

In addition to the first ducting portion, the heat exchanger may also comprise a second ducting portion on an opposite side of the core portion from the first ducting portion. The second ducting portion may have further first ducting channels for transfer the first fluid between a further first fluid inlet/outlet and the first heat exchanging channels of the core, and further second ducting channels for transfer of second fluid between a further second fluid inlet/outlet and the second heat exchanging channels. Again, the second ducting portion may have the further first ducting channels and further second ducting channels interleaved with each other.

It is not essential for the second ducting portion to direct the first and second fluids around a turn. For example, space may be less constrained on one side of a heat exchanger compared to the other and so it may be sufficient that the first ducting portion makes a turn as discussed above, but the second ducting portion could receive or output fluid in a straighter path. However, in some cases at least one further first ducting channels and further second ducting channels may direct the first fluid or the second fluid around a turn of at least 45 degrees. In the second ducting portion, it is not essential for one of the fluids to undergo a turn of at least 90 degrees.

In one example, the first and second ducting portions may comprise wedge-shaped portions disposed with hypotenuse surfaces of the wedge-shaped portions facing each other, and the core portion disposed diagonally between the hypotenuse surface is of the wedge-shape portions. Having the first and second ducting channels running within a substantially wedge-shaped portion can be convenient for directing fluid around a turn. Although the overall shape of the first/second ducting portions could also be a cuboid shape, in practice most of the turning of the fluid may happen at one corner of the cuboid, so space at the opposite corner may be wasted. By reducing the cuboid to a wedge, the turn inducing channels can occupy a smaller space. However, if the wedges are arranged with the planar end surfaces of the wedges facing each other and the core portion oriented parallel to the planar end surfaces then this can increase the amount of space required. The inventors recognise that a more space efficient approach can be to dispose the wedge-shaped portions of the first and second ducting portions with their hypotenuse surfaces facing each other so that the plane of the core portion essentially extends diagonally between the hypotenuse surfaces of the wedge-shaped portions. The hypotenuse surface may be the surface which corresponds to a hypotenuse of a right angled triangle corresponding to a cross section of the wedge-shaped portion. It is not essential for the gradient of the wedge to be constant all along the hypotenuse surface (curvature or discontinuity in the hypotenuse surface is permissible), but in general the hypotenuse surface may correspond to an inclined surface running up or down the wedge. When the core portion is disposed diagonally, the core portion may have an orientation such that the plane of the core portion extends at an angle between 0 and 90 degrees (and excluding 0 and 90 degrees) relative to an inlet or outlet direction of the first or second fluid.

The technique described in this application can be used for a parallel-flow heat exchanger, where the first and second fluids enter the heat exchanger on the same side and flow in corresponding directions through the core portion to outlets on the other side of the heat exchanger. In this case, if the first ducting portion corresponds to the inlet side of the heat exchanger then the first ducting channels may route the first fluid from a first fluid inlet to the first heat exchanging channels of the core portion, and the second ducting channels may transfer the second fluid from a second fluid inlet to the second heat exchanging channels. On the other hand, if the first ducting portion corresponds to the outlet of the heat exchanger, then the first ducting channels may transfer first fluid from a first heat exchanging channels of the core portion to a first fluid outlet and the second ducting channels may transfer the second fluid from the second heat exchanging channels of the core portion to a second fluid outlet.

However, heat exchange can be more efficient in a counter-flow heat exchanger where the first and second fluids enter the heat exchanger on opposite sides of the heat exchanger and flow in opposite directions through the first and second heat exchanging channels respectively. In this case, the first ducting portion may have first ducting channels for transferring first fluid from a first fluid inlet to the first heat exchanging channels and second ducting channels for transferring second fluid from second heat exchanging channels to a second fluid outlet. Alternatively, the first ducting portion may have first ducting channels for transferring first fluid from the first heat exchanging channels of the core to a first fluid outlet and second ducting channels for transferring second fluid from a second fluid inlet to the second heat exchanging channels of the core.

The heat exchanger could be used for a range of purposes. However, in one example the heat exchanger component may be a component of a recuperator used for recovering heat from exhaust gas from an internal combustion engine, gas turbine or other heat engine, which can for example be reused for pre-heating gas being supplied to the engine to reduce the amount of heating required by burning fuel for example.

A corresponding method of manufacturing a heat exchanger component may be provided, in which the core portion and first ducting portion are formed as discussed above with the first ducting portion comprising interleaved first ducting channels and second ducting channels. For example the core portion and the first ducting portion may be formed by additive manufacture. In additive manufacture, an article may be manufactured by successively building up layer after layer of material in order to produce the entire article. For example the additive manufacture could be by selective laser melting, selective laser sintering, electron beam melting, etc. The material used for the core portion and the first ducting portion can vary, but in some examples may be a metal, for example aluminium, titanium or steel.

The additive manufacture process may be controlled by supplying an electronic design file which represents characteristics of the design to be manufactured, and inputting the design file to a computer which translates the design file into instructions supplied to the manufacturing device. For example, the computer may slice a three-dimensional design into successive two-dimensional layers, and instructions representing each layer may be supplied to the additive manufacture machine, e.g. to control scanning of a laser across a powder bed to form the corresponding layer. Hence, in some embodiments rather than providing a physical heat exchanger component, the technique could also be implemented in a computer-readable data structure (e.g. a computer automated design (CAD) file) which represents the design of a heat exchanger component as discussed above. Thus, rather than selling the heat exchanger component in its physical form, it may also be sold in the form of data controlling an additive manufacturing machine to form such a heat exchanger component. Again, the design file need not represent the entire heat exchanger—it could just represent a component of the heat exchanger. A storage medium may be provided storing the data structure.

FIG. 1 shows an example of a heat exchanger 2, which in this example is a recuperator for recovering waste heat from exhaust gas from a gas turbine engine. In this example, the heat exchanger 2 is designed to fit around the combustion chamber of the gas turbine engine and so is curved around a central void 4. The heat exchanger 2 is this example is formed in two sections, a left hand unit 6 and a right hand unit 8 which may then be welded together after manufacture. This is done to simplify the engineering challenge of manufacturing the respective halves 6, 8 of the heat exchanger, but it will be appreciated that other examples could have a heat exchanger formed in one piece. In any case, each half 6, 8 of the heat exchanger itself functions as a complete heat exchanger with the complete recuperator 2 supporting a greater fluid volume flow rate than each individual half unit 6, 8.

The heat exchanger comprises first and second fluid inlet ducts 10, 12 which both provide a funnel-shaped portion for directing first and second fluid from an inlet pipe which can be connected to the ducts into the body of the heat exchanger. In this example the first fluid inlet duct 10 is designed to receive hot gas and the second fluid inlet duct 12 is designed to receive cold gas, but it will be appreciated that in other examples the temperature of the fluids input as the first and second fluids may be the other way round. The hot fluid supplied to the hot inlet duct 10 may for example be the exhaust gas from the combustion chamber which may pass into the heat exchanger body, through a series of first heat exchanging channels within a core portion of the heat exchanger and then output at a first fluid outlet duct 14 which is hidden in the view shown in the left hand part of FIG. 1 but is visible in the view shown in the right hand part of FIG. 1. On the other hand, the cold fluid may for example be air drawn in at the cold inlet duct 12 from outside the heat exchanger. The cold fluid is preheated by heat transfer from the hot fluid as it passes through the heat exchanger, and is output from cold outlet ducts 16, which in this example are disposed in the vicinity of the central void 4 for accommodating the combustion chamber so that the cold air can be injected into the combustion chamber as working fluid. Hence, the recuperator recovers some of the waste heat from the hot gas which would otherwise be output to the surroundings and uses this to preheat some of the cold gas entering the combustion chamber, to reduce the amount of heating required within the combustion chamber to bring the gas up to combustion temperature, which helps to save fuel and improve combustion performance.

Due to design constraints in the system which is to use the heat exchanger 2, there may be a requirement that the heat exchanger 2 is placed up against some solid barrier on one side 18 of the heat exchanger, so that the hot and cold inlet and outlet ducting cannot pass through the side 18 of the heat exchanger closest to the barrier. For example the heat exchanger may need to fit within a car boot and so the panel at the bottom of the car boot may provide a barrier to fluid inlet and outlet. This may mean that the cold and hot inlet or outlet flows may need to undergo a turn as they leave the main body of the heat exchanger.

Figure 2:
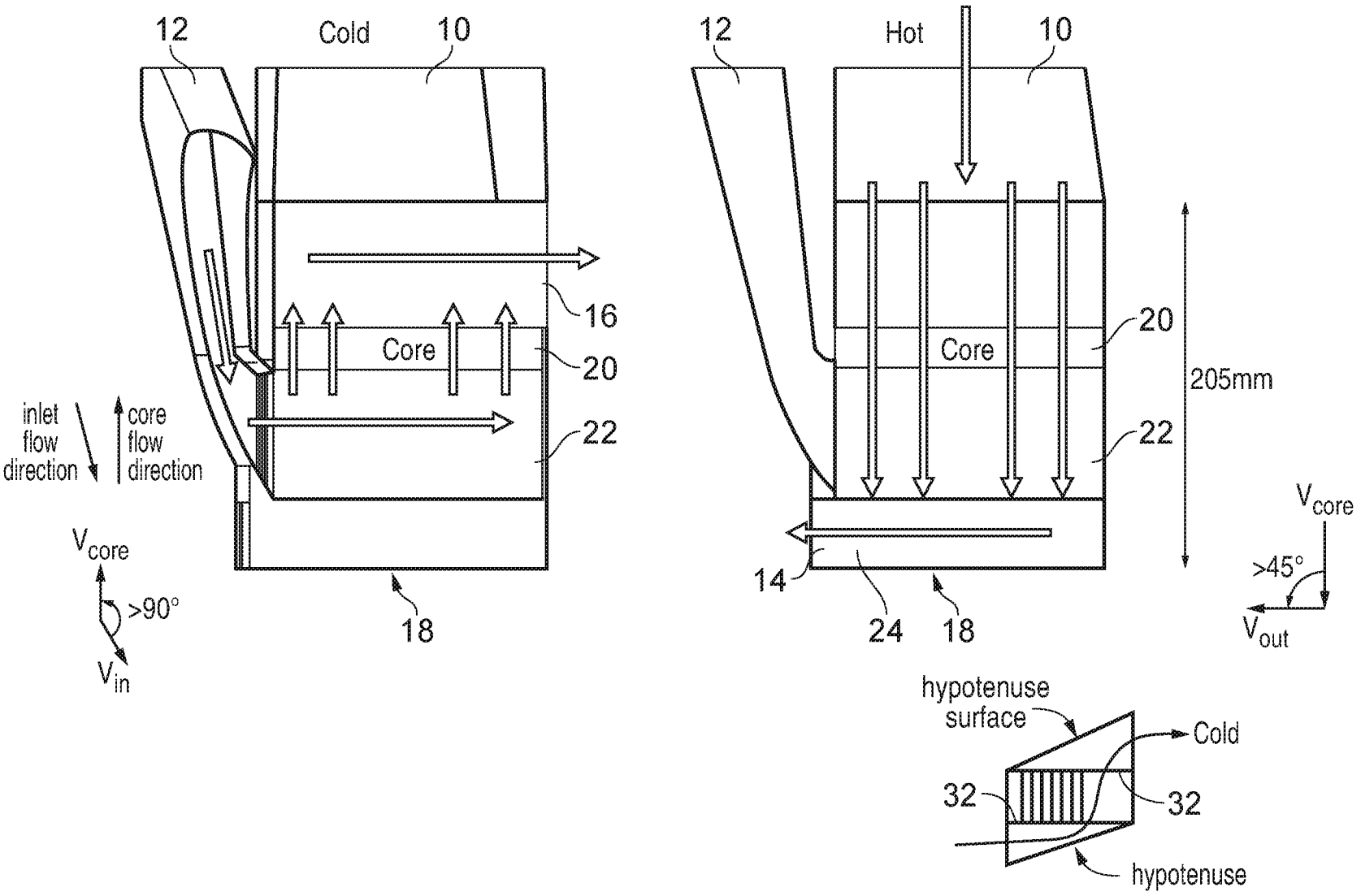
FIG. 2 shows a comparative design for the recuperator in which channels for directing first and second fluid around a turn are not interleaved.

FIG. 2 shows, for comparison, an alternative design for the heat exchanger for accommodating such turns. In this example, the heat exchanger 2 includes a heat exchanger core 20 which includes alternating heat exchanging channels for the cold and hot fluid respectively. As no fluid inlet or outlet is possible on the side 18 at the base of the heat exchanger, the cold fluid enters the cold inlet 12 at the side of the heat exchanger and undergoes a turn of greater than 90 degrees as shown in the left hand part of FIG. 2. On the other hand, the hot fluid flows into the hot inlet 10 at the top of the heat exchanger passes through the core 20, and then undergoes a turn of greater than 45 degrees (in this example approximately 90 degrees) between leaving the core 20 and reaching the hot fluid outlet 14. To facilitate making the turn, a cold fluid turning region 22 is provided in which channels are provided to direct the cold fluid around the turn of greater than 90 degrees into the corresponding cold channels within the core portion 20. Within the cold fluid turning region 22, the hot fluid simply passes straight through without making any turn and transfers into a header/footer pipe 24 which is stacked below the cold fluid turning region 22, and then the hot fluid passes along the base of the heat exchanger through the header/footer region 24 towards the hot fluid outlet 14. However, as there are separate regions 22 and 24 for turning the cold and hot fluid respectively, this tends to increase the overall size of the heat exchanger. For example, in one design in order to maintain a given performance of heat exchange for a given target hot and cold fluid temperatures, the total height of the ducting regions and core portion was around 205 mm.

Figure 3:
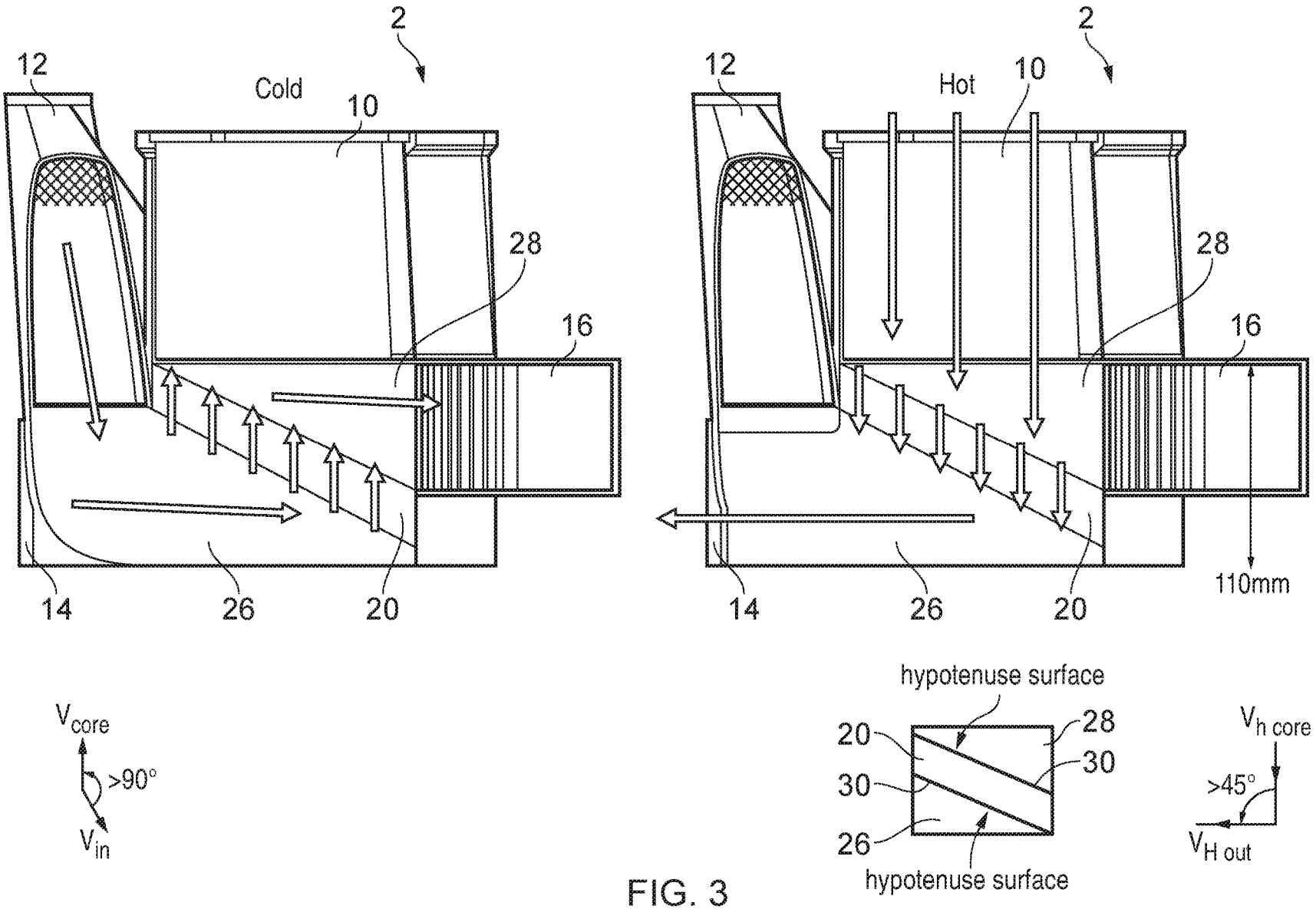
FIG. 3 shows a design according to the present technique in which the turn inducing channels for the first and second fluids are interleaved.

FIG. 3 shows an alternative design of heat exchanger in which the total space can be reduced. Again, the turn angle between the flow vectors of the cold fluid entering the inlet 12 and passing in the heat exchanger core 20 is greater than 90 degrees, and the turn angle between the hot fluid flow vector in the core 20 and the hot fluid output vector is greater than 45 degrees. However, in this design a first ducting portion 26 is provided in which first and second ducting channels for directing the first and the second fluids around the turn are interleaved with one another. In this example the first fluid corresponds to the hot fluid and the second fluid corresponds to the cold fluid. By interleaving the turn-inducing channels for the hot and cold fluids respectively, there is no need to provide an additional footer region 24 as in FIG. 2, and this enables the total height of the heat exchanger to be reduced.

Hence, the cold fluid enters the fluid inlet 12, and is turned around an angle of greater than 90 degrees by first ducting channels within the first ducting portion 26 and then passes through the core portion 20. A second ducting portion 28 is provided on the other side of the core portion 20 which then turns the cold fluid again and directs it towards the cold fluid outlet duct 16. On the other hand the hot fluid enters the hot inlet duct 10, passes through the second ducting portion 28 to the core 20, and then is turned around an angle of greater than 45 degrees within the first ducting portion 26 within first ducting channels which are interleaved with the second ducting channels carrying the cold fluid. The hot fluid is directed to the hot fluid outlet 14. In this example, the heat exchanger 2 is a counter-flow heat exchanger, but a similar approach could be used in a parallel-flow heat exchanger.

Also, while the core 20 in FIG. 2 is disposed perpendicular to the hot flow input direction and parallel to the hot fluid outlet direction, in the example of FIG. 3 the core region 20 is disposed diagonally within the heat exchanger body. That is, the first and second ducting portions 28 comprise wedge-shaped portions carrying the respective ducting channels, with the hypotenuse surfaces 30 of the respective wedges facing each other, and the core portion 20 disposed diagonally between the hypotenuse surfaces 30 as shown in the diagram at the bottom of FIG. 3. This provides a further reduction in the space compared to the approach shown in FIG. 2 where essentially it is the planar surfaces 32 of the wedges which are facing each other and so the core is disposed horizontally within the body rather than diagonally.

Hence with this design the total height of the core and ducting regions meeting the same design requirements as the example of FIG. 2 was able to be reduced to a height of 110 mm. It will be appreciated that the example heights of 205 mm and 110 mm discussed above are just one example illustrating the space saving which can be achieved by interleaving the ducting channels, but clearly other example implementations may have a different height depending on the particular design requirements of the heat exchanger.

Figure 4:
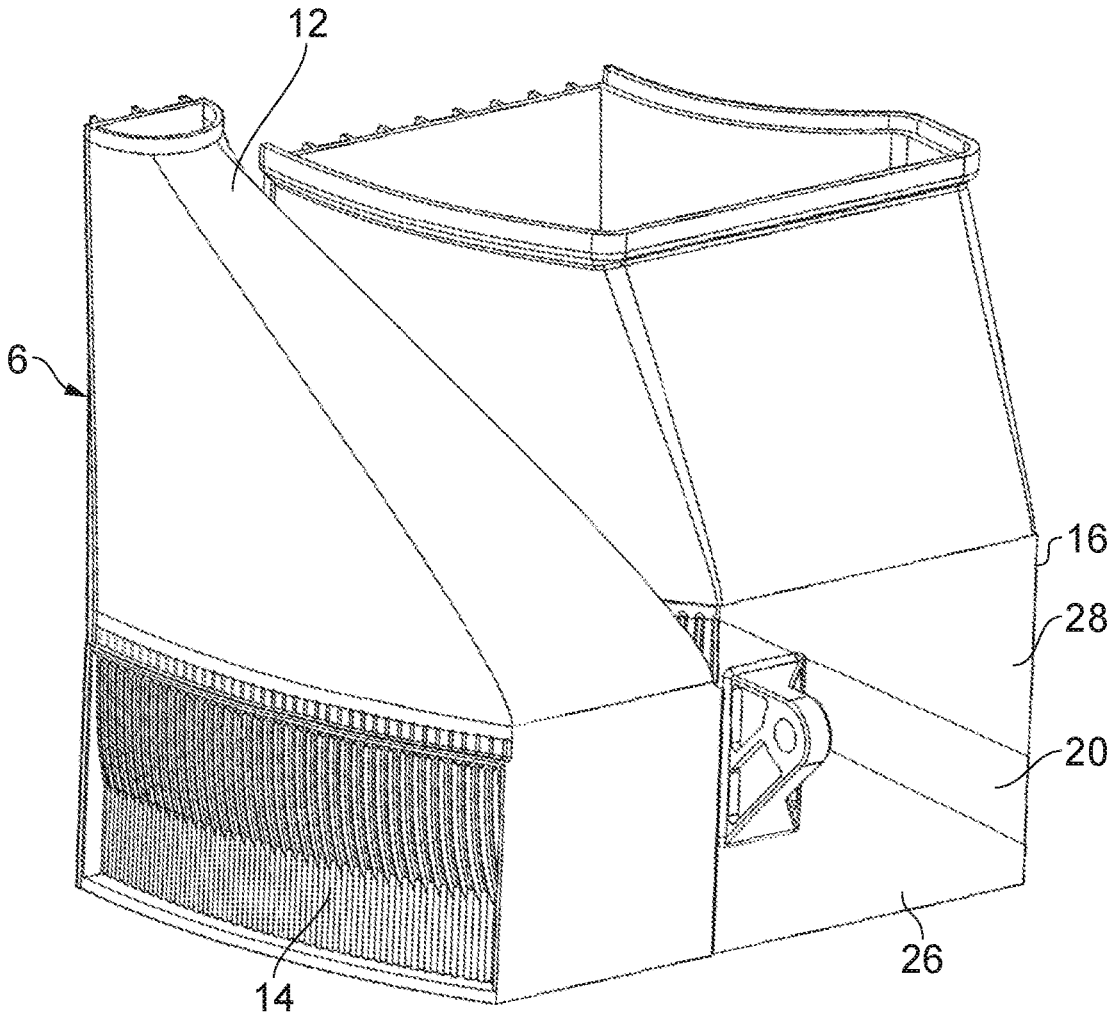
FIG. 4 illustrates a heat exchanger component of the recuperator in more detail.

FIG. 4 shows a heat exchanger component corresponding to one of the two half units 6, 8 of the heat exchanger 2, in this example the left hand unit 6. FIG. 4 illustrates the diagonal profile of the core portion relative to the orientation of the heat exchanger. The total frontal area at the input or output surface of the core portion is greater than the total front area at the hot fluid outlet 14 and cold fluid inlet 10.

Figure 5A:
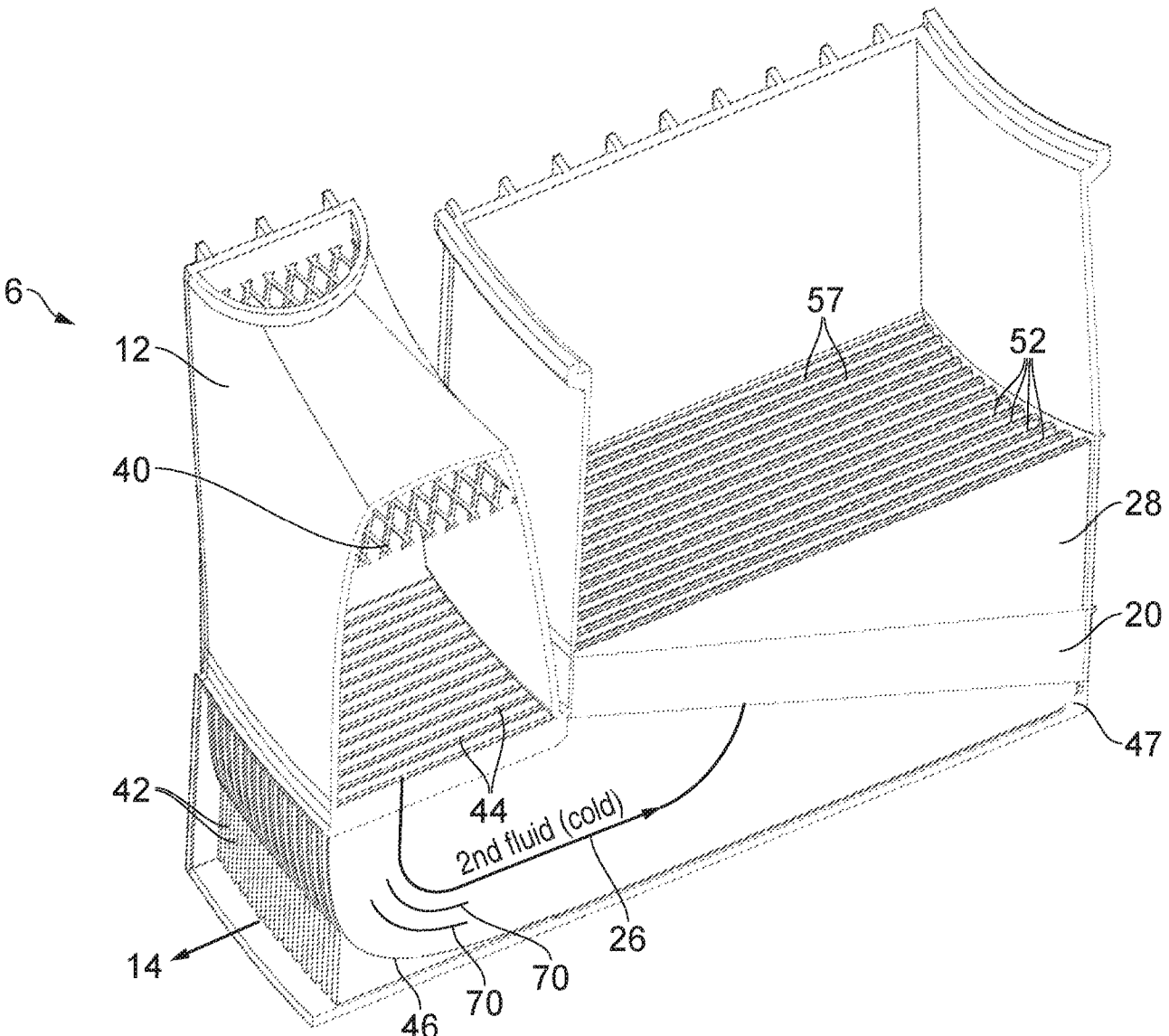
FIGS. 5A and 5B show cross section views through the recuperator illustrating the interleaved first and second ducting channels in more detail.
Figure 5B:
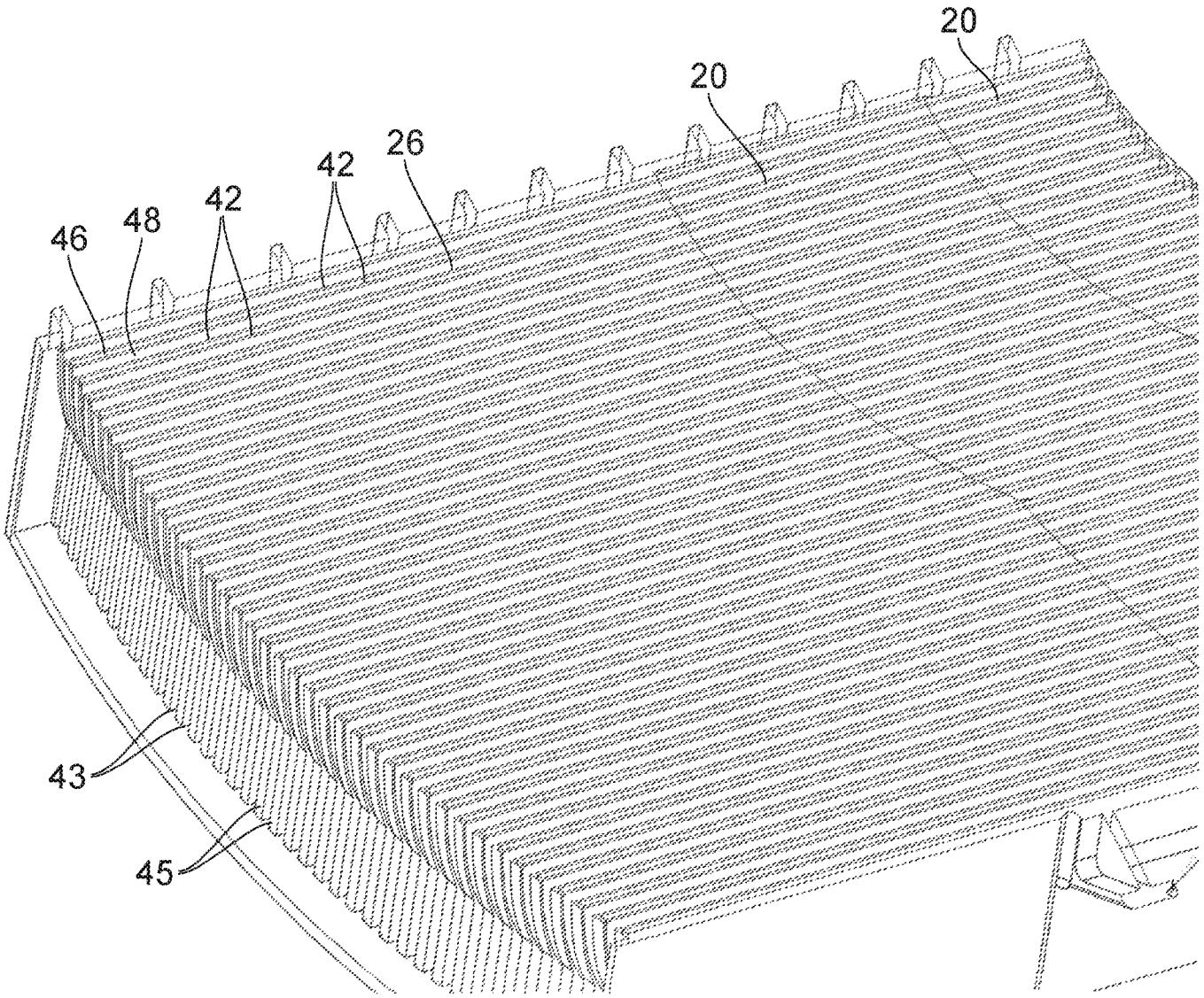

FIGS. 5A and 5B shows cross section views through the left hand heat exchanger unit 6 as shown in FIG. 4. As shown in FIG. 5A, the cold inlet duct 12 may be provided with internal meshing 40 for partitioning the flow of cold fluid as it enters the duct in order to promote splitting of the cold fluid flow between the different second ducting channels of the first ducting portion 26.

As shown in the cross section of FIGS. 5A and 5B, the first ducting portion 26 may include a series of interleaved first and second ducting channels with the first ducting channels transferring first (hot) fluid from the core region 20 to the hot fluid outlet 14 and the second ducting channels transferring second fluid (cold fluid) from the cold fluid inlet 12 to the core region 20. The first and second ducting channels have a series of dividing walls 42 which travel along the channels towards core region 20. The first ducting channels 48 have openings 43 at the ends corresponding to the hot fluid outlet region 14 but are closed with barriers 44 at the side adjacent to the cold fluid inlet 12. The second ducting channels 49 for transferring the cold fluid are open at the region corresponding to the cold inlet 12 but are closed with barriers 45 at the end corresponding to the hot outlet 14 (see FIG. 5B). The cold fluid (second) ducting channels 49 include an internal profile with a turn inducing surface 46 which guides the cold fluid around the turn towards the core region. Similarly, the hot fluid channels 48 have a turn inducing surface 47 at the other end of the heat exchanger for guiding hot fluid leaving the core region 20 around a turn towards the hot outlet 14.

Also, optionally one or more turning vanes 70 may be formed within the second ducting channels 49 for assisting with directing the cold fluid around the turn. The turning vanes 70 may internally subdivide the second ducting channels for providing internal surfaces which help to deflect the cold fluid around the turn. The turning vanes 70 may be formed within the channels by additive manufacture (e.g. during formation of the channel walls, as the layers are built up by additive manufacture, bridging portions can be build out from the channel walls on both sides of the channel, which as more layers are built up approach to meet in the middle of the channel to form an internal partition bridging across the channel. The turning vanes 70 need not extend along the full length of the channel. For example, the turning vanes 70 may be provided at the corner of the turn but not at other parts. The turning vanes 70 could have an aerofoil shape or other suitable shape. The shape of the turning vanes 70 can be determined by performing computational fluid dynamics simulations of the fluid passing through the channels for multiple candidate shapes and selecting the shape giving the best performance. Alternatively, other examples may not have any turning vanes 70.

Figure 6:
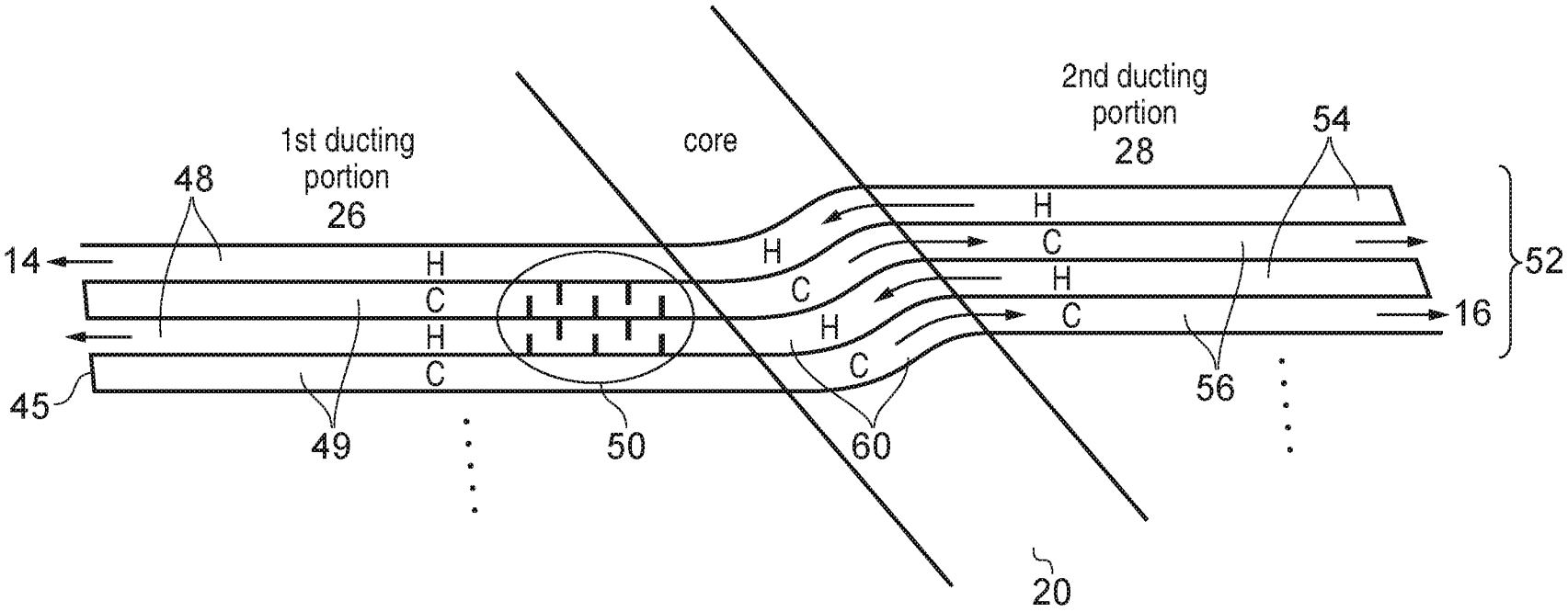
FIG. 6 is a diagram schematically illustrating ducting channels and heat exchanging channels.

FIG. 6 schematically illustrates the channels in more detail, including the heat exchanging channels 60 in the core portion and ducting channels in the first and second ducting portions 26, 28. In the first ducting portion 28, the ends of the cold ducting channels 49 are closed on the side of the hot outlet 14, while the ends of the hot ducting channels 48 are open to allow escape of the hot fluid into the hot outlet 14. The openings of the cold ducting channels 49 would be at the surfaces at the top or bottom of the channels as viewed in the direction passing in and out of the page. As shown in FIG. 6, one or both of the cold and hot ducting channels 49, 48 may have additional heat exchange assisting features 50 formed on the inner surfaces of the channels to promote heat exchange between the hot and cold fluid path through the channels by increasing the total amount of surface area at the interface between the hot and cold fluid. In this example the heat exchange assisting features are pins formed on the walls of the channels, but in other examples they could be ribs or fins.

As shown in FIGS. 5A, 5B and 6, the second ducting portion 28 may similarly comprise a series of interleaved further first and second ducting channels 52, including further first ducting channels 54 for carrying the hot fluid from the hot inlet duct 10 to the core region 20 and further second ducting channels 56 for carrying the cold fluid from the core region 22 to the cold outlet duct 16. In this example the cold ducting channels 56 in the second ducting portion 28 are open at the ends to output fluid to the cold duct while having barriers 57 on the tops of the channels in the region exposed to the hot inlet duct 10, while the hot (further first fluid) ducting channels 54 are closed at the end corresponding to the cold outlet duct 16 and open at the tops to receive hot fluid from the hot inlet duct 10. While not shown in FIG. 6 the second ducting portion 28 could have heat exchange assisting features 50 similar to the first ducting portion 26.

Hence, by interleaving the channels which induce the respective turns in the first and second fluids, the efficiency of space usage can be improved.

The cross-section of the heat exchanging channels 60 of the heat exchanger core can be non-uniform along the width of the channels. In some examples, the heat exchanging channels may have a hydraulic diameter of less than 10 mm. More particularly, the hydraulic diameter of the heat exchanger channels 60 may be less than 5 mm, or less than 2 mm, or less than 1 mm, or less than 0.5 mm. Similarly, the first/second ducting channels of the first ducting portion may have a hydraulic diameter of less than 10 mm, less than 5 mm, less than 2 mm, less than 1 mm, or less than 0.5 mm. Similarly, the further first/second ducting channels of the second ducting portion may have a hydraulic diameter of less than 10 mm, less than 5 mm, less than 2 mm, less than 1 mm, or less than 0.5 mm. At such small scales, it would typically be considered impractical to form interleaved turn inducing channels through standard manufacturing techniques such as moulding or casting, however the inventors recognised that it is possible using additive manufacture for example.

Figure 7:
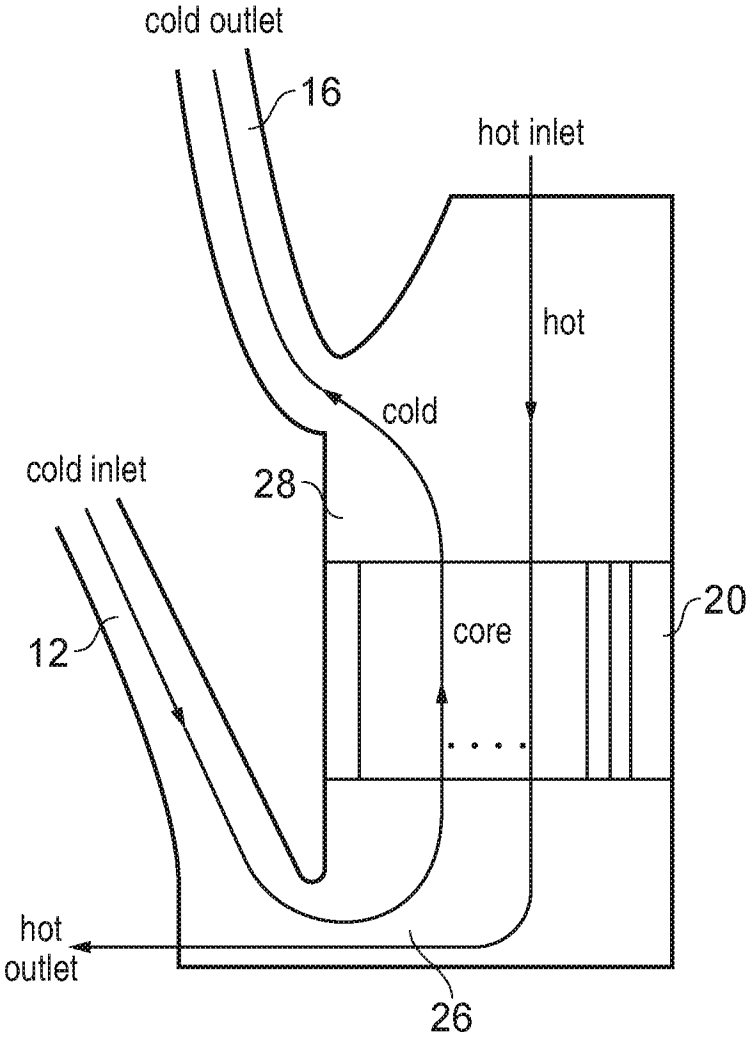
FIG. 7 shows a second example of a heat exchanger.
Figure 7:
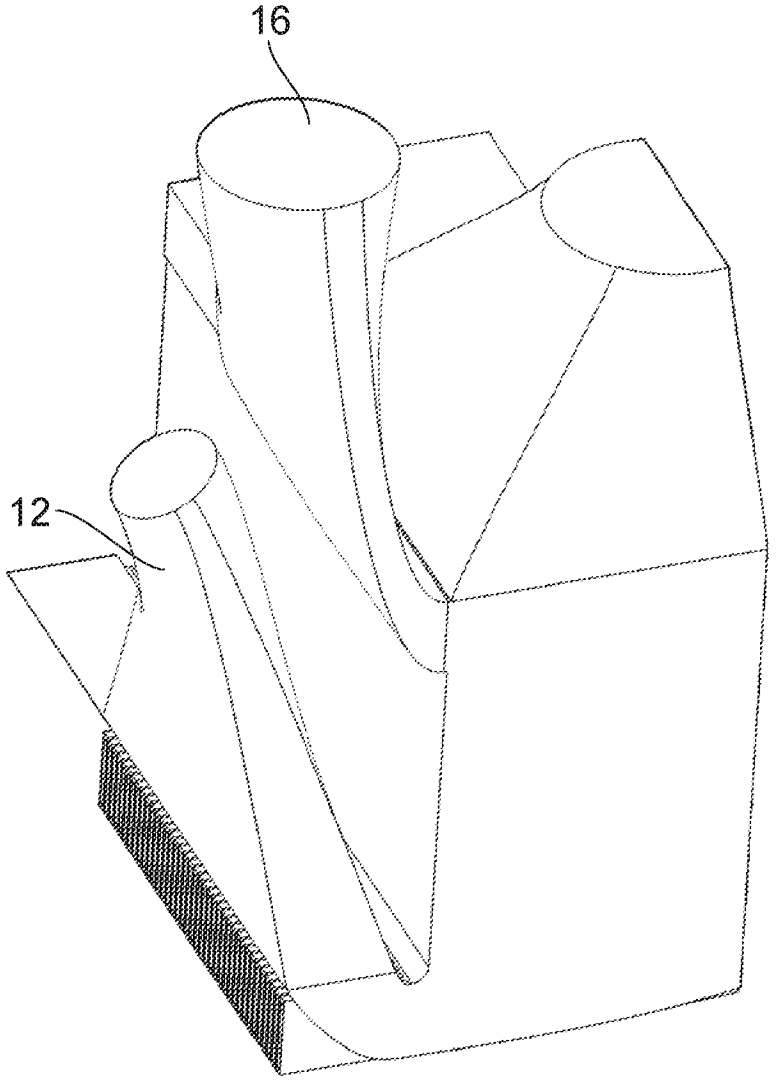
Figure 8:
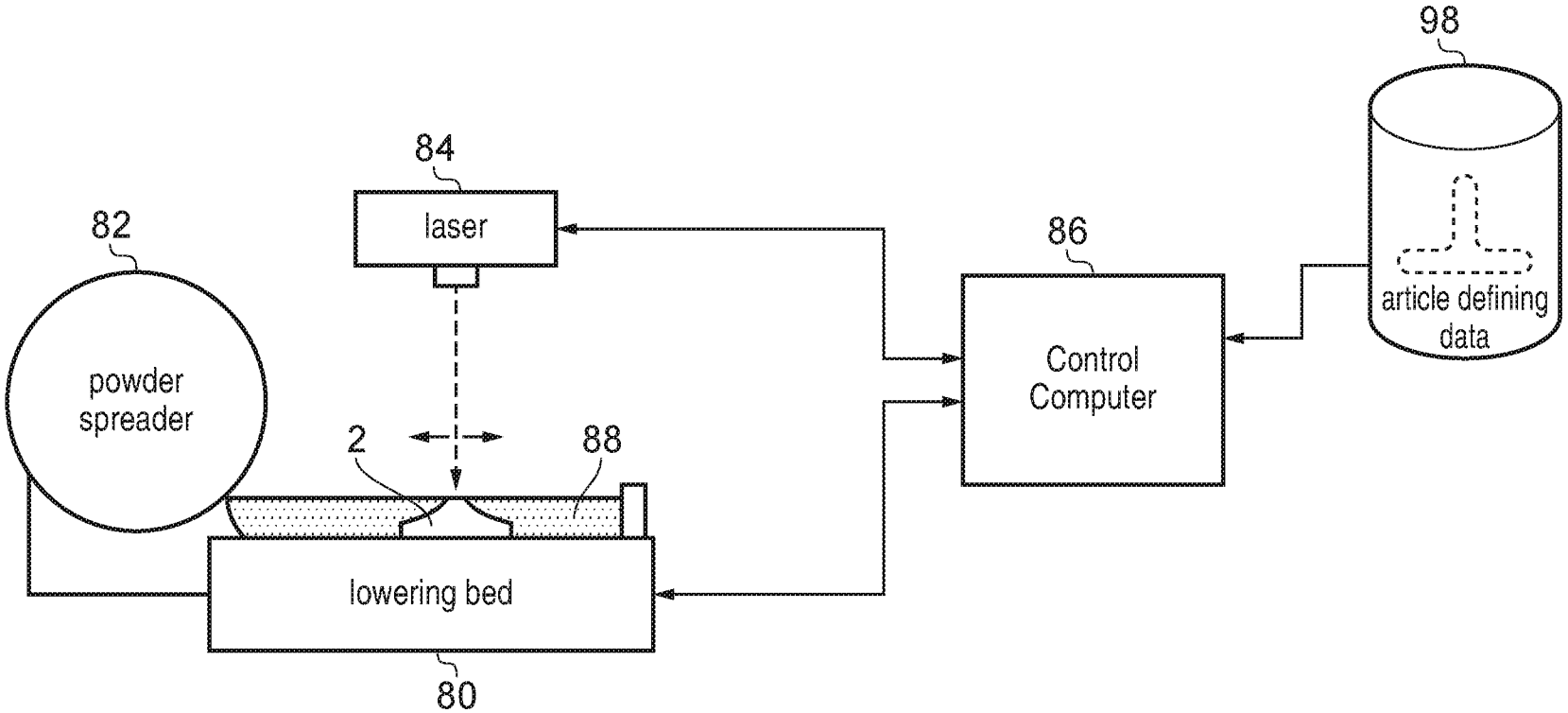
FIG. 8 illustrates a process for manufacturing a heat exchanger using additive manufacture.

The locations of the hot and cold inlet/outlet ducts 10, 12, 14, 16 can vary for different designs. FIGS. 1 to 6 show an example where the cold fluid takes a Z- or S-shaped path from the cold inlet to the cold outlet (with the cold inlet and cold outlet on opposite sides of the heat exchanger), but this is not essential. As shown in FIG. 7 an alternative design could route the cold fluid along a C-, V- or U-shaped path where the cold outlet 16 is on the same side of the heat exchanger as the cold inlet 12. In this case, it may not be possible to dispose the core region diagonally across the heat exchanger in the same way as described above and instead the core may be parallel to the base of the heat exchanger as shown in FIG. 7. Nevertheless, by providing a first ducting region 26 in which turn-inducing ducting channels are interleaved for the hot and cold fluids, space efficiency of the heat exchanger can be improved.

FIG. 7 schematically illustrates additive manufacture. In this example, laser fused metal powder 88 is used to form an article such as the heat exchanger 2 or a component of the heat exchanger described above. The article 2 is formed layer-by-layer upon a lowering a powder bed 80 on top of which thin layers of metal power to be fused are spread by a powder spreader 82 prior to being melted (fused) via a scanning laser beam provided from a laser 84. The scanning of the laser beam via the laser 84, and the lowering of the bed 80, are computer controlled by a control computer 86. The control computer 86 is in turn controlled by a computer program (e.g. computer data defining the article 2 to be manufactured). This article defining data is stored upon a computer readable non-transitory medium 98. FIG. 7 illustrates one example of a machine which may be used to perform additive manufacture. Various other machines and additive manufacturing processes are also suitable for use in accordance with the present techniques whereby ducting channels for routing first and second fluids between a core portion of a heat exchanger and inlet/outlet are interleaved.

Further example arrangements are set out in the following numbered clauses:

1. A heat exchanger component comprising:

a core portion comprising alternating first and second heat exchanging channels for exchange of heat between first fluid in the first heat exchanging channels and second fluid in the second heat exchanging channels; and a first ducting portion comprising first ducting channels for transfer of first fluid between a first fluid inlet/outlet and the first heat exchanging channels of the core portion and second ducting channels for transfer of second fluid between a second fluid inlet/outlet and the second heat exchanging channels of the core portion;

wherein the first ducting channels are configured to direct the first fluid around a turn of at least 45 degrees;

the second ducting channels are configured to direct the second fluid around a turn of at least 90 degrees; and the first ducting channels are interleaved with the second ducting channels.

2. The heat exchanger component according to clause 1, wherein the first ducting channels provide a different flow path geometry to the second ducting channels.

3. The heat exchanger component according to any of clauses 1 and 2, wherein the first fluid inlet/outlet is separate from, and not interleaved with, the second fluid inlet/outlet.

4. The heat exchanger component according to any preceding clause, wherein the second ducting channels are configured to direct the second fluid around a turn with a greater angle than the turn provided by the first ducting channels for the first fluid.

5. The heat exchanger component according to any preceding clause, wherein the second ducting channels are configured to direct the second fluid around a turn of greater than 90 degrees.

6. The heat exchanger component according to any preceding clause, wherein at least one heat exchange assisting feature is formed on an inner surface of at least one of the first ducting channels and the second ducting channels of the first ducting portion.

7. The heat exchanger component according to any preceding clause, wherein the first and second ducting channels of the first ducting portion have a greater hydraulic diameter than the first and second heat exchanging channels of the core portion.

8. The heat exchanger component according to any preceding clause, wherein a total frontal area of the first heat exchanging channels of the core portion is greater than a total frontal area of the first fluid inlet/outlet.

9. The heat exchanger component according to any preceding clause, wherein a total frontal area of the second heat exchanging channels of the core portion is greater than a total frontal area of the second fluid inlet/outlet.

10. The heat exchanger component according to any preceding clause, wherein the core portion is integrally formed with the first ducting portion.

11. The heat exchanger component according to any preceding clause, comprising a second ducting portion on an opposite side of the core portion from the first ducting portion, the second ducting portion comprising further first ducting channels for transfer of first fluid between a further first fluid inlet/outlet and the first heat exchanging channels and further second ducting channels for transfer of second fluid between a further second fluid inlet/outlet and the second heat exchanging channels, wherein the further first ducting channels are interleaved with the further second ducting channels.

12. The heat exchanger component according to clause 11, wherein in the second ducting portion at least one of the first ducting channels and the second ducting channels are configured to direct the first fluid or the second fluid around a turn of at least 45 degrees.

13. The heat exchanger component according to any of clauses 11 and 12, wherein the first and second ducting portions comprise wedge-shaped portions disposed with hypotenuse surfaces of the wedge-shaped portions of the first and second ducting portions facing each other and the core portion disposed diagonally between the hypotenuse surfaces of the wedge-shaped portions.

14. The heat exchanger component according to any preceding clause, wherein the heat exchanger component comprises a component of a counter-flow heat exchanger.

15. The heat exchanger component according to any preceding clause, wherein the heat exchanger component comprises a component of a recuperator.

16. A method of manufacturing a heat exchanger component, the method comprising:

forming a core portion comprising alternating first and second heat exchanging channels for exchange of heat between first fluid in the first heat exchanging channels and second fluid in the second heat exchanging channels; and forming a first ducting portion comprising first ducting channels for transfer of first fluid between a first fluid inlet/outlet and the first heat exchanging channels of the core portion and second ducting channels for transfer of second fluid between a second fluid inlet/outlet and the second heat exchanging channels of the core portion;

wherein the first ducting channels are configured to direct the first fluid around a turn of at least 45 degrees;

the second ducting channels are configured to direct the second fluid around a turn of at least 90 degrees; and the first ducting channels are interleaved with the second ducting channels.

17. The method of clause 16, wherein the core portion and the first ducting portion are formed by additive manufacture.

18. A computer-readable data structure representing a design of a heat exchanger component comprising:

a core portion comprising alternating first and second heat exchanging channels for exchange of heat between first fluid in the first heat exchanging channels and second fluid in the second heat exchanging channels; and a first ducting portion comprising first ducting channels for transfer of first fluid between a first fluid inlet/outlet and the first heat exchanging channels of the core portion and second ducting channels for transfer of second fluid between a second fluid inlet/outlet and the second heat exchanging channels of the core portion;

wherein the first ducting channels are configured to direct the first fluid around a turn of at least 45 degrees;

the second ducting channels are configured to direct the second fluid around a turn of at least 90 degrees; and the first ducting channels are interleaved with the second ducting channels.

19. A storage medium storing the computer-readable data structure of clause 18.

In the present application, the words "configured to . . . " are used to mean that an element of an apparatus has a configuration able to carry out the defined operation. In this context, a "configuration" means an arrangement or manner of interconnection of hardware or software. For example, the apparatus may have dedicated hardware which provides the defined operation, or a processor or other processing device may be programmed to perform the function. "Configured to" does not imply that the apparatus element needs to be changed in any way in order to provide the defined operation.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

The invention claimed is:

1. A heat exchanger component comprising:

a core portion comprising alternating first and second heat exchanging channels for exchange of heat between first fluid in the first heat exchanging channels and second fluid in the second heat exchanging channels, wherein the first heat exchanging channels and the second heat exchanging channels are configured to direct the first and second fluids along corresponding routes in the same direction or opposite directions; and a first ducting portion comprising first ducting channels for transfer of first fluid between a first fluid inlet/outlet and the first heat exchanging channels of the core portion and second ducting channels for transfer of second fluid between a second fluid inlet/outlet and the second heat exchanging channels of the core portion, wherein the first ducting channels provide a different flow path geometry to the second ducting channels, and the first fluid inlet/outlet is separate from, and not interleaved with, the second fluid inlet/outlet;

wherein the first ducting channels are configured to direct the first fluid around a turn of at least 45 degrees;

the second ducting channels are configured to direct the second fluid around a turn for which a turn angle between a flow vector of the second fluid at the second fluid inlet/outlet and a flow vector of the second fluid in the core portion is greater than 90 degrees;

the first ducting portion is formed as a consolidated mass of material; and the first ducting channels are interleaved with the second ducting channels.

2. The heat exchanger component according to claim 1, wherein the second ducting channels are configured to direct the second fluid around a turn with a greater angle than the turn provided by the first ducting channels for the first fluid.

3. The heat exchanger component according to claim 1, wherein at least one heat exchange assisting feature is formed on an inner surface of at least one of the first ducting channels and the second ducting channels of the first ducting portion.

4. The heat exchanger component according to claim 1, wherein the first and second ducting channels of the first ducting portion have a greater hydraulic diameter than the first and second heat exchanging channels of the core portion.

5. The heat exchanger component according to claim 1, wherein a total frontal area of the first heat exchanging channels of the core portion is greater than a total frontal area of the first fluid inlet/outlet.

6. The heat exchanger component according to claim 1, wherein a total frontal area of the second heat exchanging channels of the core portion is greater than a total frontal area of the second fluid inlet/outlet.

7. The heat exchanger component according to claim 1, wherein the core portion is integrally formed with the first ducting portion in said consolidated mass of material.

8. The heat exchanger component according to claim 1, comprising a second ducting portion on an opposite side of the core portion from the first ducting portion, the second ducting portion comprising further first ducting channels for transfer of first fluid between a further first fluid inlet/outlet and the first heat exchanging channels and further second ducting channels for transfer of second fluid between a further second fluid inlet/outlet and the second heat exchanging channels, wherein the further first ducting channels are interleaved with the further second ducting channels.

9. The heat exchanger component according to claim 8, wherein in the second ducting portion at least one of the first ducting channels and the second ducting channels are configured to direct the first fluid or the second fluid around a turn of at least 45 degrees.

10. The heat exchanger component according to claim 8, wherein the first and second ducting portions comprise wedge-shaped portions disposed with hypotenuse surfaces of the wedge-shaped portions of the first and second ducting portions facing each other and the core portion disposed between the hypotenuse surfaces of the wedge-shaped portions.

11. The heat exchanger component according to claim 1, wherein the heat exchanger component comprises a component of a counter-flow heat exchanger.

12. The heat exchanger component according to claim 1, wherein the heat exchanger component comprises a component of a recuperator.

13. The heat exchanger component according to claim 1, wherein at least one of the first ducting channels and second ducting channels comprises a curved flow turning surface for directing fluid around the turn.

14. The heat exchanger component according to claim 13, wherein the curved flow turning surface comprises an inner surface of the first or second ducting channel.

15. A method of manufacturing a heat exchanger component, the method comprising:

forming a core portion comprising alternating first and second heat exchanging channels for exchange of heat between first fluid in the first heat exchanging channels and second fluid in the second heat exchanging channels, wherein the first heat exchanging channels and the second heat exchanging channels are configured to direct the first and second fluids along corresponding routes in the same direction or opposite directions; and forming a first ducting portion comprising first ducting channels for transfer of first fluid between a first fluid inlet/outlet and the first heat exchanging channels of the core portion and second ducting channels for transfer of second fluid between a second fluid inlet/outlet and the second heat exchanging channels of the core portion, wherein the first ducting channels provide a different flow path geometry to the second ducting channels, and the first fluid inlet/outlet is separate from, and not interleaved with, the second fluid inlet/outlet;

wherein the first ducting channels are configured to direct the first fluid around a turn of at least 45 degrees;

the second ducting channels are configured to direct the second fluid around a turn for which a turn angle between a flow vector of the second fluid at the second fluid inlet/outlet and a flow vector of the second fluid in the core portion is greater than 90 degrees;

the first ducting portion is formed as a consolidated mass of material; and the first ducting channels are interleaved with the second ducting channels.

16. The method of claim 15, wherein the core portion and the first ducting portion are formed by additive manufacture.

* * * * *